US007047961B2

(12) United States Patent
Eckstein

(10) Patent No.: US 7,047,961 B2
(45) Date of Patent: May 23, 2006

(54) TILE CUTTING MACHINE

(75) Inventor: Joachim Eckstein, Fulda (DE)

(73) Assignee: Fliesen Eckstein GmbH & Co. KG, Fulda-Bernhards (DE)

( * ) Notice: Subject to any disclaimer, the term of this patent is extended or adjusted under 35 U.S.C. 154(b) by 193 days.

(21) Appl. No.: 10/738,137

(22) Filed: Dec. 18, 2003

(65) Prior Publication Data

US 2004/0231485 A1 Nov. 25, 2004

(30) Foreign Application Priority Data

Dec. 20, 2002 (DE) ..... 102 59 867

(51) Int. Cl.
*B28D 1/02* (2006.01)

(52) U.S. Cl. ..... 125/12; 83/468.3; 125/13.01

(58) Field of Classification Search ..... 83/468.3; 125/12, 13.01, 14, 23.02; 225/96.5
See application file for complete search history.

(56) References Cited

U.S. PATENT DOCUMENTS 2,568,816 A * 9/1951 Edward ..... 125/23.02
5,169,045 A * 12/1992 Liu ..... 225/96.5
5,598,637 A * 2/1997 Liu ..... 33/526
5,615,665 A * 4/1997 Thiriet ..... 125/23.02
5,626,124 A * 5/1997 Chen ..... 125/23.02
6,053,159 A * 4/2000 Liu ..... 125/23.02
6,240,914 B1 * 6/2001 Yasuga ..... 125/23.02
6,672,190 B1 * 1/2004 Taylor ..... 83/435.14

FOREIGN PATENT DOCUMENTS

DE 87 15 018.2 12/1987
DE 91 11 400.4 11/1991
DE 91 14 140.0 1/1992
DE 93 17 402.0 1/1994
DE 44 04 915 C1 2/1994

* cited by examiner

*Primary Examiner*—Timothy V. Eley
(74) *Attorney, Agent, or Firm*—Crowell & Moring LLP

(57) ABSTRACT

A tile cutting machine including a supporting plate for a tile to be cut, a tool guide running over the supporting plate and a swivel head which can be moved by defined angular amounts. A ruler with a straight guide is included in the swivel head. Two laterally reversed try squares can be inserted selectively from the right or left side of the swivel head into the straight guide of the swivel head.

6 Claims, 2 Drawing Sheets

TILE CUTTING MACHINE

BACKGROUND AND SUMMARY OF THE INVENTION

This invention relates to a tile cutting machine and, more particularly, to a tile cutting machine comprising a supporting plate for a tile to be cut, a tool guide running over the supporting plate for a cutting tool and a swivel head which can be moved by defined angular amounts about a swivel head axis and which holds a try square. The try square has a contact bar and is provided with a measuring scale and can be slid lockingly in a straight guide of the swivel head with a guide bar. The contact bar extends at right angles to the guide bar. Additionally the swivel head has a ruler with a contact edge which runs through the swivel axis.

A tile cutting machine is the subject of DE 87 15 018.2 U1. In the prior art tile cutting machine both legs of the try square form one contact edge each for the tile to be cut. One leg of the try square is guided in a straight guide of the swivel head so that it can be clamped and that leg carries a measuring scale so that one can read the distance between the other contact edge and the swivel axis. The drawback with the prior art tile cutting machine is that the try square forms with one leg a contact edge and with its other leg projects automatically always towards the same side of the supporting plate. When one must cut the tiles at an angle or diagonally so that they are adapted, for example, to the contour of a right hand or left hand tilt angle, then the try square has to be adjusted when changing from the left to the right tilt angle, and the requisite dimension can no longer be read directly on the measuring scale of the try square, but rather a difference has to be calculated and that difference has to be set with the try square, a procedure that runs, of course, the risk of an error. It would be simpler for right and left walls or tilt angles to put the tiles to be cut on the tile cutting machine, as a function of the wall side, with the front side or the rear side up, a feature that is almost impossible, because normally it is possible to cut tiles, only by scoring their front side with a cutting tool.

The invention is based on the problem of designing the tile cutting machine in such a manner that for all possible angular or diagonal cuts the requisite dimension can be read directly on the measuring scale of the try square.

This problem is solved, according to the invention, by a total of two laterally reversed try squares for insertion into the straight guide starting from the side opposite the swivel head axis.

This design makes it possible to install selectively one or the other try square into the tile cutting machine for right or left walls or tilt angles. Thus, the dimension, measured with a rule, between the last laid tile and the edge, up to which the tile to be laid is supposed to reach, can be set directly on the try square, so that there is no need to convert dimensions. Similarly the desired angle of an angular cut can be easily set.

The range, over which the try square can be moved, can be chosen especially large, if, according to an improvement of the invention, the ruler projects beyond the swivel head in the direction of the sides, oriented in opposite directions, forms a first contact edge and has a continuous straight guide, into which the guide bar of the respective try square can be installed.

Even lengths that can no longer be read on the ruler, can be set without tedious computing and without having to resort to the additional aid of a separate rule, if both sides of the swivel head axis have a ruler with a measuring scale that begins with zero, starting from the swivel axis; and the guide bar has a measuring scale that begins with zero when its respective contact edge is above the swivel head axis.

Common angular dimensions, such as 45°, 60° or 120°, can be set on the swivel head without having to pay attention to whether the lines on a scale line up when, according to another improvement of the invention, the swivel head forms a semi-circular segment and has indexing notches on a fixed pitch circle with uniform angular spacing and when the supporting plate has a spring-loaded ball detent for dropping a ball into the individual indexing notches. Owing to this design, the swivel head drops releaseably into the most useful angular positions.

The swivel head can be locked into position in an especially simple way, if on the outside along the periphery of the swivel head a curved member, provided with an angle scale, is recessed, so as not to rotate, into the supporting plate. The curved member exhibits a graduation in the direction of the swivel head, when the swivel head has correspondingly a graduation, oriented in the direction of the curved member, and when a clamping bolt's head, aligning with the upper side of the swivel head and the curved member, sits on the two graduations. The clamping bolt, penetrating the supporting plate, is designed so as to move into a clamping position by means of a clamping device.

One advantageous design is embodied in an embodiment according to which the clamping bolt has a nut on the rear side of the supporting plate; and the clamping device has a clamping fork, which is to be slid into its clamping position between the nut of the clamping bolt and the supporting plate by means of an adjusting lever.

The invention permits various embodiments. For further illustration of its basic principle, one embodiment is depicted in the drawings and is described below.

DETAILED DESCRIPTION OF THE DRAWINGS

Figure 1:
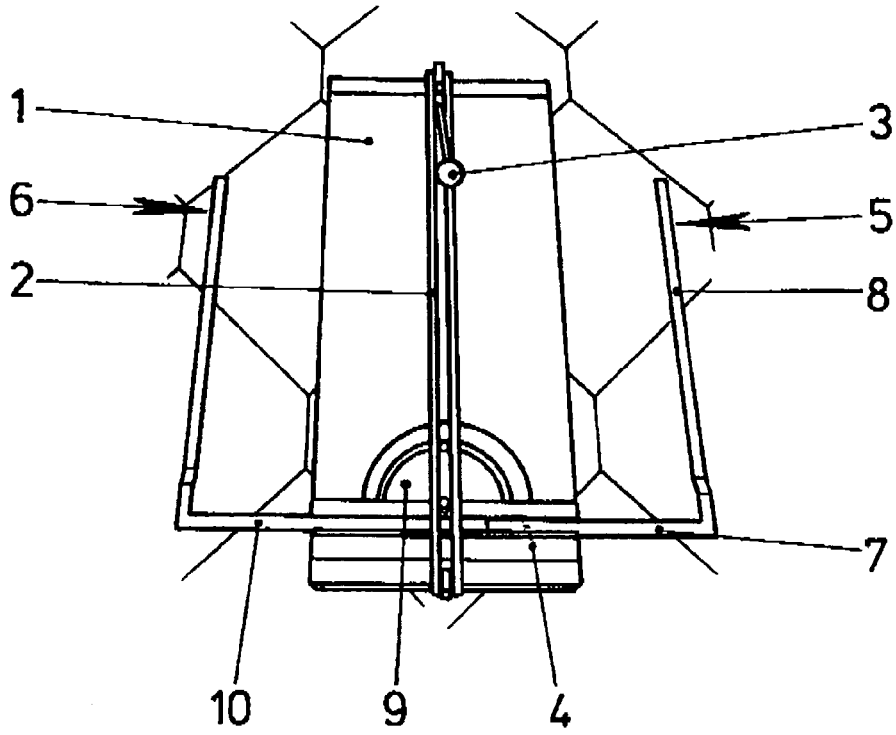
FIG. 1 is a perspective top view of a tile cutting machine, according to the invention.

FIG. 1 depicts a wood supporting plate 1, over which stretches a tool guide 2, along which is to move by means of a hand lever 3 a cutting tool (not illustrated) in the form of a wheel to be rolled over the tile to be cut. To position the tile to be cut there is a ruler 4 and two try squares 5, 6, where, depending on the side of the wall for which the tiles are to be cut, the one try square 5 or the other try square 6 is used.

The two try squares 5, 6 have one guide bar 7, 10, respectively, which can be fixed moveably in the ruler 4 and in the respectively desired position. Furthermore, each try square 5, 6 has a contact bar 8, which is oriented relative to the guide bar 7, 10 at right angles and against which the tile to be cut is supposed to be placed with an edge, which is not to rest against the ruler 4. To enable also angular cuts, the ruler 4 is arranged on a swivel head 9.

Figure 2:
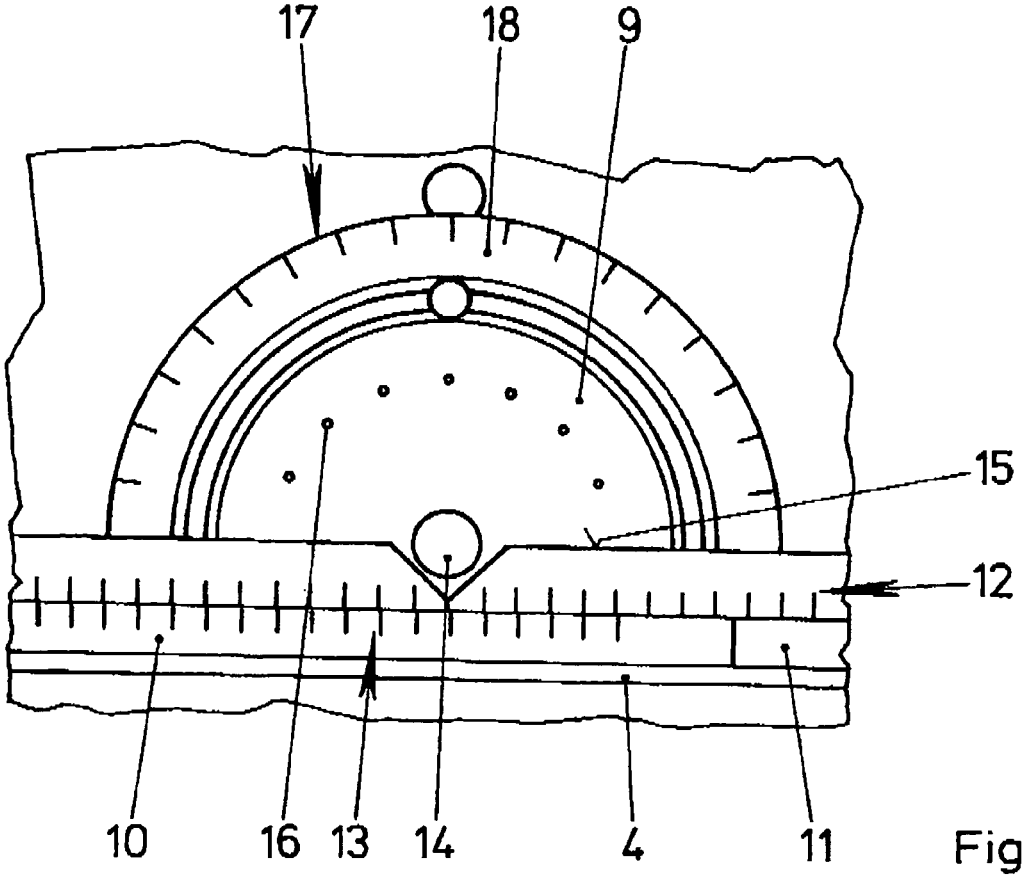
FIG. 2 is a top view of a swivel head of the tile cutting machine.

In contrast to FIG. 1, FIG. 2 is an enlarged view of the swivel head 9 with the ruler 4. This ruler 4 has a straight guide 11, in which the guide bar 10 can be recognized. Both on the ruler 4 and on the guide bar 10 one sees a measuring scale 12, 13, with which it is possible to set a desired dimension for the cut of the tile. Furthermore, FIG. 2 shows a swivel head axis 14, about which the swivel head 9 with the ruler 4 can be swiveled by a defined amount. The ruler 4 has a contact edge 15, which runs through the swivel head axis 14.

In the swivel head 9 there are indexing notches 16 in the form of boreholes, all of which are located on a common pitch circle and into which a spring loaded ball (not illustrated) can drop in from the bottom of the swivel head. Thus, predetermined angular positions of the swivel head 9 can be fixed in advance so that during adjustment they do not have to be carefully checked. A curved member 17 with an angle scale 18 runs along the periphery of the swivel head 9 forming a semi-circular segment. Thus, it is possible to read the respective angular amount when one swivels the swivel head 9.

Figure 3:
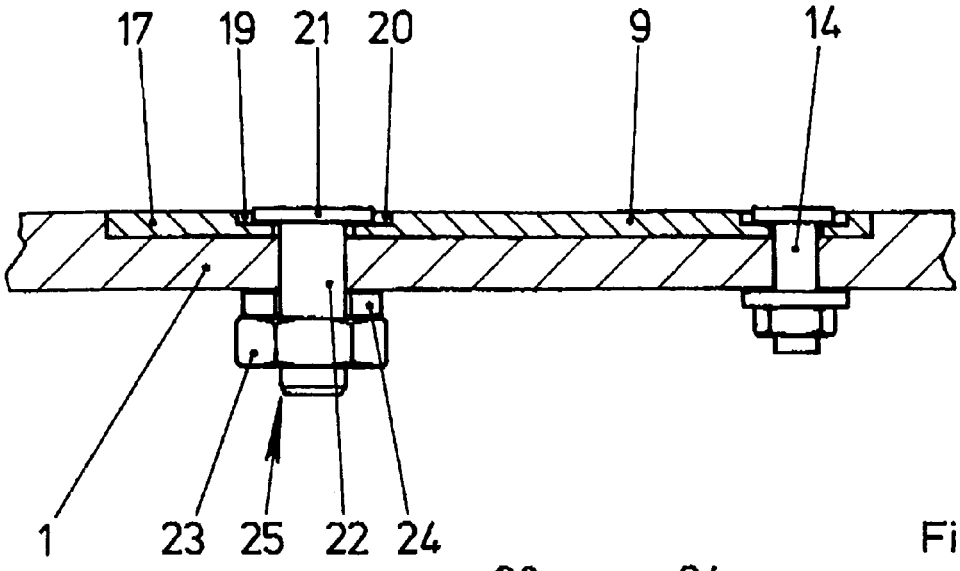
FIG. 3 is a sectional view of a supporting plate of the tile cutting machine.

FIG. 3 is a sectional view of the supporting plate 1, with the swivel head 9, which is recessed therein and which can be rotated about the swivel axis 14, and with the curved member 17. The curved member 17 and the swivel head 9 have a graduation 19, 20, both of which face each other and on which a clamping head 21 of a clamping bolt 22 is mounted. The latter has on the bottom side of the supporting plate 1 a nut 23. Between this nut 23 and the supporting plate 1 there is a clamping fork 24. FIG. 3 shows two prongs of this clamping fork 24, the prongs being designed in the shape of a wedge. The clamping fork 24 forms, together with the clamping bolt 22, the clamping head 21 and the nut 23, a clamping device 25.

Figure 4:
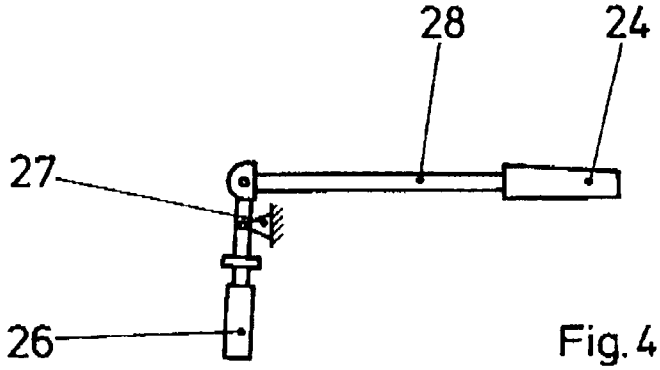
FIG. 4 depicts a clamping device.

FIG. 4 depicts an adjusting lever 26, which is to be fastened to the bottom side of the supporting plate 1 by means of a bearing block 27. If the adjusting lever 26 is swiveled relative to the bearing block 27, then a rod 28 moves the clamping fork 24 and tightens or loosens the swivel head 9 in that the clamping head 21 sits on the graduation 20 or releases it, a procedure that can be seen in FIG. 3.

Figure 5:
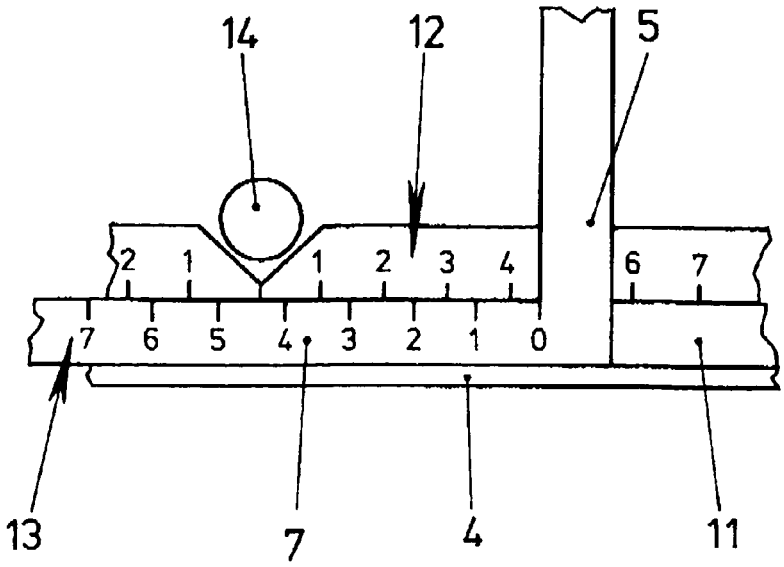
FIG. 5 is a ruler and a try square of the tile cutting machine.

FIG. 5 shows the ruler 4 with the straight guide 11, in which the guide bar 7 of try square 5 can slide. From the guide bar 7 the try square 5 moves over the top side of the rule. To this end it is offset. Furthermore, FIG. 5 shows the arrangement of the measuring scales 12, 13.

The invention claimed is:

1. A tile cutting machine, comprising:

a supporting plate;

a tool guide for a cutting tool running over the supporting plate;

a swivel head movable by defined angular amounts about a swivel head axis and including:

a ruler with a contact edge that runs through the swivel head axis; and a straight guide; and two laterally reversed try squares each insertable into the straight guide from a respective side of the straight guide on opposing sides of the swivel head axis, wherein each try square includes a guide bar and a contact bar extending at a right angle to the guide bar and wherein a measuring scale is included on the guide bar;

wherein each guide bar of the two try squares is lockingly slidable in the straight guide.

2. The tile cutting machine as claimed in claim 1, wherein the ruler projects beyond the swivel head in a direction of the opposing sides of the swivel head axis and forms a first contact edge and has a continuous straight guide into which the guide bar of the respective try square is insertable.

3. The tile cutting machine as claimed in claim 2, wherein on the opposing sides of the swivel head axis the ruler has a measuring scale that begins with zero starting from the swivel head axis and wherein the measuring scale of each guide bar begins with zero at an edge of the contact bar that adjoins the guide bar.

4. The tile cutting machine as claimed in claim 1, wherein the swivel head forms a semi-circular segment and has indexing notches on a fixed pitch circle with uniform angular spacing and wherein the supporting plate has a spring-loaded ball that is receivable into a one of the indexing notches.

5. The tile cutting machine as claimed in claim 1, wherein on an outside along a periphery of the swivel head a curved member provided with an angle scale is recessed into the supporting plate so as not to rotate, the curved member having a graduation in a direction of the swivel head and the swivel head having a corresponding graduation oriented in a direction of the curved member, wherein a clamping head of a clamping bolt sits on the two graduations and aligns with an upper side of the swivel head and the curved member, and wherein the clamping bolt penetrates the supporting plate and is movable into a clamping position by means of a clamping device.

6. The tile cutting machine as claimed in claim 5, wherein the clamping bolt has a nut on a rear side of the supporting plate and the clamping device has a clamping fork which is slidable into a clamping position between the nut and the supporting plate by means of an adjusting lever.

* * * * *